United States Patent [19]

Santefort

[11] Patent Number: 4,517,917

[45] Date of Patent: May 21, 1985

[54] BLOW-OFF MANIFOLD FOR PREVENTING TRAILING FROM A NON-CONTACT EXTRUSION ADHESIVE APPLICATION VALVE

[75] Inventor: Richard A. Santefort, Hamilton, Ohio

[73] Assignee: Valco Cincinnati, Inc., Cincinnati, Ohio

[21] Appl. No.: 604,052

[22] Filed: Apr. 26, 1984

[51] Int. Cl.[3] ..... B05B 15/04

[52] U.S. Cl. ..... 118/302; 118/300; 118/677; 118/669

[58] Field of Search ..... 118/669, 684, 25, 302, 118/300, 677

[56] References Cited

U.S. PATENT DOCUMENTS

| | | | |
|---|---|---|---|
| 3,177,846 | 4/1965 | Archer et al. | 118/315 |
| 3,876,144 | 4/1975 | Madden et al. | 118/302 |
| 4,408,562 | 10/1983 | DeCamp et al. | 118/659 |

*Primary Examiner*—Shrive P. Beck

*Attorney, Agent, or Firm*—Frost & Jacobs

[57] ABSTRACT

A device for preventing trailing of glue extruded by an exclusion nozzle following termination of the dispensing of the glue. A pair of spaced apart orifices are positioned to direct a thin jet of air for a brief period of time on either side of the stream of glue being dispensed at the moment of glue cut-off to momentarily entrain the stream and draw it generally in the direction of the path of travel of the workpiece. The air jets are oriented so as not to touch or impinge on the glue stream, thereby preventing break-up of the glue stream.

11 Claims, 8 Drawing Figures

BLOW-OFF MANIFOLD FOR PREVENTING TRAILING FROM A NON-CONTACT EXTRUSION ADHESIVE APPLICATION VALVE

SUMMARY OF THE INVENTION

The present invention is directed generally to systems for applying a coating to a moving workpiece, and more particularly to apparatus for preventing adhesive trailing from a non-contact adhesive application valve.

One common way of applying a spot or stripe of a liquid adhesive to a moving substrate such as a partially completed cardboard box blank is by means of a non-contact extrusion valve. The valve is spaced a small distance immediately above the surface of the moving substrate, and the liquid adhesive is forced under pressure from the valve in a relatively thin stream. The application valve may be either pneumatically or electrically operated so that the flow of adhesive may be initiated at a particular point and terminated at a subsequent point. The specific points at which the flow is initiated or terminated determine the adhesive pattern on the substrate, and are usually under control of a programmable electronic control system. In order to provide an accurate pattern, the timing of the opening and closing of the valve is extremely important, particularly in situations where the substrate is moving at high speed, or the pattern must be very accurately controlled. For example, even slight delays in the turn-on and turn-off points of the valve may result in the adhesive pattern missing the substrate completely, or, in the case where the pattern is being deposited on flaps of a carton prior to closing, the adhesive may spill over into the contents of the container.

One problem which has been encountered with such adhesive application systems is that of "trailing" or "tailing". As a result of mechanical delays in the valve, and for other reasons, the cut-off of the adhesive stream from the extrusion valve nozzle may not be clean, and the end of the stream may tend to drip or dribble onto the surface of the moving substrate. Consequently, instead of having a clearly defined cut-off point for the adhesive pattern, the adhesive tends to trail or tail in a thin line of decreasing width. This undesirable tail or trail may thus fall into areas of the substrate which should not be glued together, or may fall into the contents of a package, as noted above. In any event, tailing or trailing of the glue pattern has been found to be a serious and undesirable effect of some types of adhesive application systems.

Furthermore, whether or not a particular adhesive application installation will cause trailing or tailing is generally unpredictable. The tendency of the adhesive to tail is dependant upon many factors such as the viscosity and characteristics of the adhesive, the amount of air entrained in the adhesive, the temperature, the spacing between the extrusion valve nozzle and the substrate, the size of the adhesive stream or pattern, the characteristics and speed of travel of the substrate, and so forth.

One method which has been suggested for eliminating such adhesive tailing or trailing is described in U.S. Pat. No. 4,408,562 issued Oct. 11, 1983 to J. E. DeCamp et al. In this arrangement, a short jet of air is directed onto the stream issuing from the extrusion nozzle at the moment of termination of the stream so that the adhesive is blown back onto the already deposited pattern, rather than tailing off.

It has been found, however, that under some circumstances impinging the air jet directly on the adhesive stream may cause the stream to break up into small globules which can be propelled onto other parts of the moving substrate, or blown off of the substrate entirely.

The present invention is directed to apparatus for preventing trailing of the adhesive material on the workpiece surface following termination of the dispensing of the adhesive from the extrusion valve nozzle where the air jet does not come into direct contact with the adhesive stream.

The invention comprises a blow-off manifold containing a pair of spaced apart orifices positioned to direct a thin jet of air on either side of the stream of cooling material being dispensed from the extrusion nozzle. The orifices are angularly disposed at a slight angle so that the air jets diverge. The air jets issuing from the orifices are operable to momentarily entrain the adhesive stream at the moment of application termination and draw it generally in the direction of the path of travel of the workpiece.

Consequently, the terminal portion of the stream is drawn back onto the already deposited adhesive on the substrate. Since the air jets do not directly come in contact with the adhesive stream, the possibility of break-up of the stream is substantially reduced.

Further features of the invention will become apparent from the detailed description which follows.

DETAILED DESCRIPTION

Figure 1:
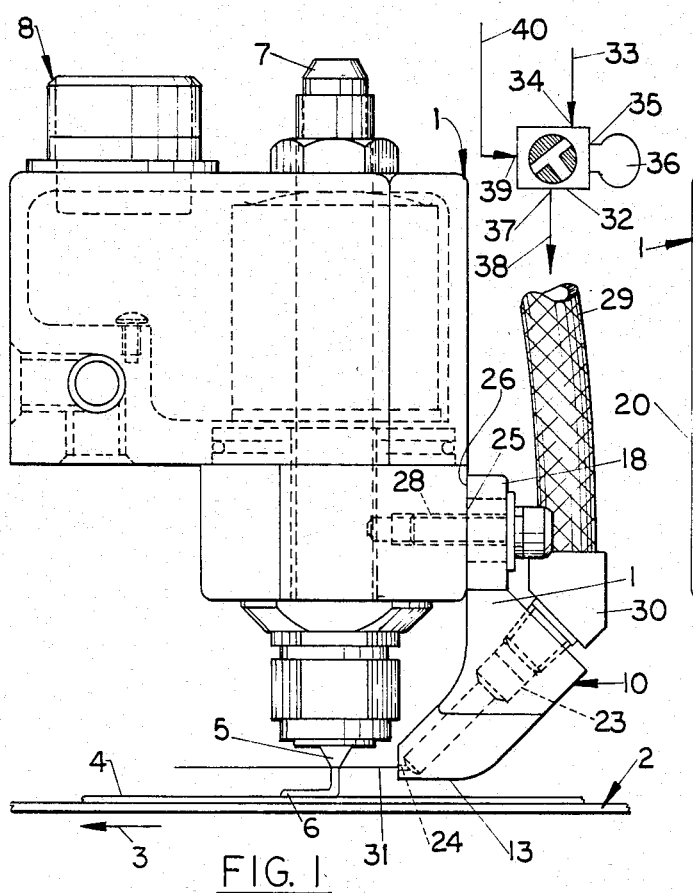
FIG. 1 is a partially schematic fragmentary side elevation view of the blow-off manifold of the present invention installed in connection with an extrusion nozzle.

FIG. 1 illustrates a typical adhesive application installation utilizing a non-contact extrusion valve, shown generally at 1, mounted in overlying relationship with a generally horizontally disposed planar conveyor, illustrated generally at 2. It will be understood that conveyor 2 is moved in the direction of arrow 3 by means not shown at a generally constant rate.

The workpiece or substrate 4 to which the adhesive is to be applied rests upon and is carried along by the conveyor 3. For purposes of an exemplary showing, the workpiece 4 is illustrated as a thin flat member, such as an unfolded box blank.

The liquid adhesive is discharged from the lower end of valve 1 through an extrusion nozzle shown generally at 5 in a relatively thin stream 6.

It will be observed that the lowermost end of extrusion nozzle 5 is spaced slightly above the upper surface of the workpiece 4. Consequently, the stream 6 of liquid adhesive issuing from the nozzle traverses a short vertical distance before it is applied in a relatively thin layer to the upper surface of the workpiece.

The remainder of the extrusion valve 1 is substantially conventional in construction, and includes an inlet port 7 to which a suitable flexible liquid adhesive supply hose (not shown) may be connected to the valve, and a structure, shown generally at 8, for fixedly mounting the valve in a position overlying the workpiece conveyor 2.

As described hereinabove, when the flow of adhesive from extrusion nozzle 5 terminates, the portion of the liquid adhesive stream 6 between the lower end of the extrusion nozzle and the upper surface of the workpiece, as well as a small quantity of adhesive within the valve, will continue to be dispensed and applied to the workpiece surface, thereby causing the undesired tailing. The blow-off manifold of the present invention, illustrated generally at 10, is designed to prevent this tailing effect.

As can best be seen in FIG. 4–FIG. 7, blow-off manifold 10 comprises a block-like main body 11 having a generally vertical front face 12 and a generally horizontal lower surface 13. The rear surface 14 of body 11 slopes rearwardly and upwardly, terminating in a transversely extending edge 15. The rear upper surface 16 then continues upwardly and forwardly. The front upper surface extends rearwardly and upwardly, as at 17. The upper portion of body 1 terminates in an upwardly extending mounting flange 18 having a pair of outwardly disposed ears 19.

Each of mounting ears 19 is provided with a vertically extending slot 20 for mounting the blow-off manifold to valve 1 as will be described in more detail hereinafter.

Figure 5:
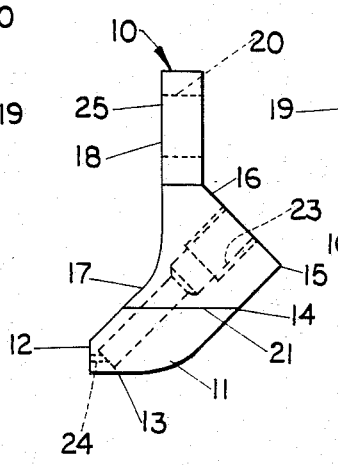
FIG. 5 is a side elevation view of the blow-off manifold of FIG. 4.
Figure 7:
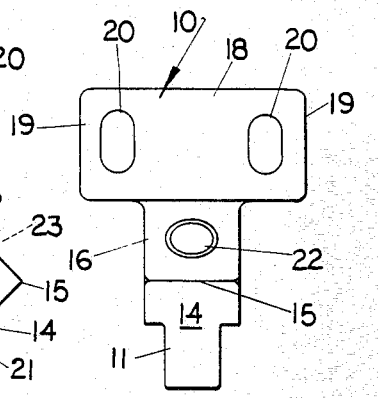
FIG. 7 is a rear elevational view of the blow-off manifold of FIG. 4.

A central bore 21 extends angularly downwardly through body 11, beginning at rear upper surface 16, and terminating slightly inwardly of the junction of vertical front face 12 and horizontal lower surface 13. As best shown in FIG. 5, bore 21 terminates in a circular counterbore 22 which is threaded to accept an air pressure fitting, as at 23.

A pair of horizontally spaced, generally horizontal air orifices 24 extend from the lower portion of vertical front face 12 rearwardly, intersecting at their rearmost ends with the lower part of central bore 21. As can best be seen in FIG. 4, the central axes of air orifices 24 diverge slightly, preferably at an angle a of about 5°–15°. The angle formed by the central axes of air orifices 24 may be varied, depending upon the size of the adhesive stream issuing from extrusion nozzle 5 as will be explained in more detail hereinafter.

Figure 2:
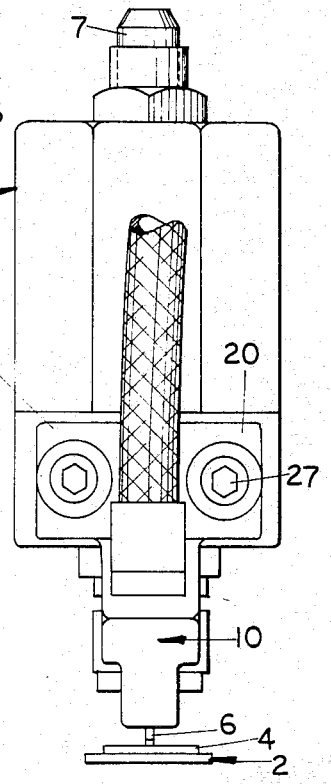
FIG. 2 is a rear elevation view of the installation of FIG. 1.
Figure 3:
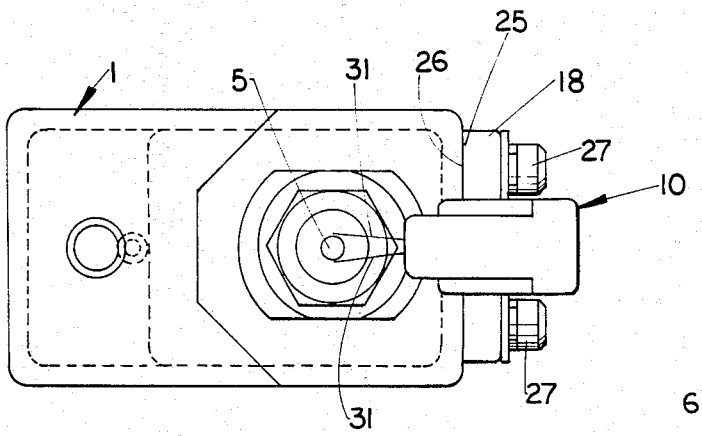
FIG. 3 is a bottom plan view of the installation of FIG. 1.

The mounting of blow-off manifold 10 to extrusion valve 1 is illustrated in FIG. 1–3. The forward face 25 of mounting flange 18 is mounted flush against the flat mounting surface 26 of extrusion valve 1. Blow-off manifold 10 is then secured to the valve by means of a pair of socket head screws 27 which pass through mounting slots 20 in mounting ears 19, and threadedly engage a cooperating bore 28 in the valve body.

It will be observed that this mounting arrangement positions blow-off manifold 10 so that lower surface 13 will be spaced slightly above the upper surface of workpiece 4. More importantly, however, this mounting arrangement orients air orifices 24 so that their central axes diverge toward the vertical longitudinal axis passing through extrusion nozzle 5.

Figure 3A:
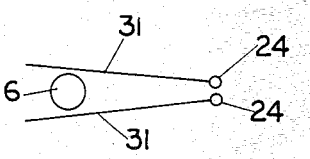
FIG. 3A is a diagrammatic plan view looking upwardly at the bottom of the valve and blow-off manifold.
Figure 4:
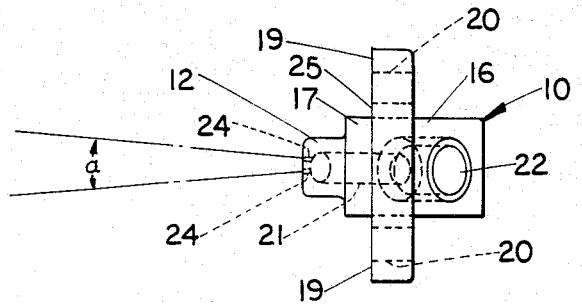
FIG. 4 is a top plan view of the blow-off manifold of the present invention.
Figure 6:
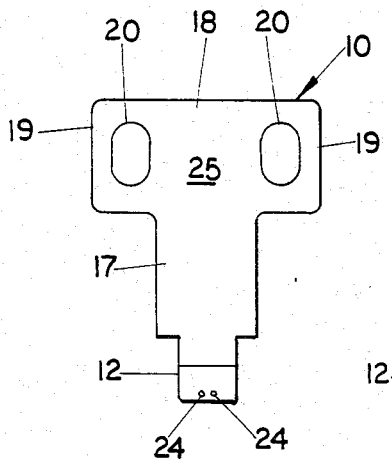
FIG. 6 is a front elevational view of the blow-off manifold of FIG. 4.

A suitable air hose 29 is connected by means of an elbow connection 30 which threadedly engages threaded bore 23 in body 1. When pressurized air is applied through air hose 29 and central bore 21, a pair of spaced, slightly diverging air jets will issue from air orifices 24. The spacing of orifices 24, and the angularly divergence of the orifices are chosen such that the air jets, shown diagrammatically at 31, are directed to either side of the adhesive stream issuing from the extrusion nozzle. In other words, as illustrated diagrammatically in FIG. 3A, each of the air jets 31 issuing from the associated air orifice 24 is directed and dimensioned to just miss the outside edges of the glue application stream 6 issuing downwardly from nozzle 5. Air jets 31 thus operate to momentarily entrain the glue stream and draw it generally in the direction of the path of travel 3 of workpiece 4. It will be particularly observed that neither of air jets 31 actually impinges upon or touches the glue stream. Since the air jets do not directly come in contact with the adhesive stream, the possibility of break-up of the stream is substantially reduced.

It will be observed that not only is the angular divergence of air jets 31 important, but also the size of the air jets. In a preferred embodiment, it has been found that orifices having a diameter of about 0.040 inches, and a horizontal spacing of about 0.060 inches between centers, with an included angle of about 10° between central axes of the orifices, produces excellent results.

As noted above, it is desirable to entrain the glue stream with the air jets only at the moment of glue cut-off so as to avoid glue tailing. This may be accomplished by means of a three-way valve system 32 of the type illustrated in FIG. 1.

Pressurized air from a pressurized air source (not shown) is applied on line 33 to the three-way valve inlet 34. The outlet 35 of three-way valve 32 is connected to a small chamber 36 forming an air reservoir. The exhaust port 37 of the three-way valve is connected by means of a suitable air line 38 to air hose 29. The solenoid control input 39 to three-way valve 32 is connected to an electrical line 40 which is responsive to the same single used to control the flow of glue from extrusion valve 1.

In operation, the electrical signal on line 40 operates to turn three-way valve 32 off when extrusion valve 1 is actuated to permit the flow of glue from extrusion nozzle 5. This causes pressurized air from line 33 to be shunted to reservoir 36, thereby filling the reservoir with a small volume of pressurized air. For purposes of an exemplary showing, it has been found that a reservoir 36 having a volume of about one-half to one cubic inch, with a supply line air pressure of about 60 psi produces good results. It will be observed that during this state of operation of three-way valve 32, there is no airflow to air hose 29, and consequently no air issues from air orifices 24.

When extrusion valve 1 shuts off, the concurrent electrical signal on line 40 opens three-way valve 32, exhausting the volume of air trapped in reservoir 36 into outlet port 37, and hence to air hose 29. This causes a burst of air in the form of air jet 31 to issue from orifices 24 for a very short period of time, on the order of several milliseconds. In other words, the small volume of air trapped in reservoir 36 produces air jets 31 which momentarily entrains the last bit of glue issuing from the extrusion nozzle, causing the glue to be drawn generally in the direction of the path of travel of workpiece 4, thereby preventing glue trailing. It will be understood that the air pressure and/or volume of reservoir 36 may be adjusted to provide just the right amount of air at the right pressure and duration to entrain the terminal "drip" of adhesive issuing from the extrusion nozzle just as the valve shuts off to thereby move the "drip" in the direction of travel of the workpiece. In general, the terminal portion of glue so entrained is only moved a short distance, and is laid gently on the portion of the glue already deposited on the workpiece surface.

Consequently, it will be observed that the present invention prevents trailing of the adhesive on the workpiece surface following termination of the dispensing of the adhesive from the extrusion valve nozzle. Furthermore, the air jet does not come in direct contact with the adhesive stream, so that the possibility of break-up of the stream is substantially reduced.

It will be understood that various changes in the steps, details, materials and arrangements of parts, may be made by those skilled in the art according to the principle and scope of the invention as expressed in the appended claims.

The embodiments of the invention in which an exclusive property or privilege is claimed are as follows:

1. In a system for applying a coating to the surface of a moving workpiece of the type having conveying means for moving the workpiece along a predetermined path of travel, and applicator means for applying a coating of liquid material to a predetermined location on a major surface of the workpiece including nozzle means spaced adjacent said major surface for dispensing the liquid material in a relatively thin stream toward the workpiece surface, said applicator means including means for initiating and for terminating the dispensing of the coating material, the improvement in combination therewith comprising means for preventing trailing of the coating material on the workpiece surface following termination of the dispensing of the coating material including a pair of spaced apart blow-off orifices positioned to direct a thin jet of air on either side of the stream of coating material being dispensed from the nozzle means and generally in the direction of path of travel of the workpiece, and means for producing said air jets immediately following termination of the dispensing of the coating material, said jets being operable to momentarily entrain the stream and draw it generally in the direction of the path of travel of the workpiece.

2. The apparatus according to claim 1 wherein the axes of said orifices are angularly disposed with respect to the stream such that said air jets diverge.

3. The apparatus according to claim 2 wherein the axis of said orifices are disposed in an angle of about 5°–15°.

4. The apparatus according to claim 2 wherein said orifices are oriented such that said air jets are substantially parallel to said major surface of the workpiece.

5. The apparatus according to claim 1 wherein said nozzle means comprises a non-contact extrusion nozzle.

6. The apparatus according to claim 5 wherein said nozzle is oriented such that said stream is substantially vertical.

7. The apparatus according to claim 6 wherein said orifices are oriented such that said air jets are substantially horizontal.

8. In a system for applying liquid adhesive at predetermined positions on the upper surface of a workpiece moving along a predetermined path of travel including an applicator nozzle positioned above the workpiece for dispensing the adhesive in a relatively thin vertical stream toward and upon the workpiece surface and means for initiating and terminating the dispensing of the adhesive from the nozzle, the improvement in combination therewith comprising means for preventing trailing of the adhesive on the workpiece surface following termination of the dispensing of the adhesive including a pair of spaced apart orifices positioned to produce a thin generally horizontal jet of air on either side of the adhesive being dispensed from the nozzle and generally in the direction of the path of travel of the workpiece, said orifices being configured to produce air jets which entrain the adhesive stream without direct contact therewith and draw it generally in the path of travel of the workpiece and means for producing air jets of short duration from said orifices upon termination of dispensing of the adhesive from the nozzle.

9. The apparatus according to claim 8 wherein said orifices are positioned such that said air jets diverge on either side of said adhesive stream.

10. The apparatus according to claim 9 wherein said air jets diverge at an angle of about 5°–15°.

11. The apparatus according to claim 10 wherein said orifices are oriented such that said air jets are substantially parallel to the upper surface of the workpiece.

* * * * *